US006634307B2

(12) United States Patent
Resta

(10) Patent No.: US 6,634,307 B2
(45) Date of Patent: Oct. 21, 2003

(54) APPARATUS FOR INSERTING TUFTING STRAPS IN A MATTRESS

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 0 days.

(21) Appl. No.: 10/126,535

(22) Filed: Apr. 22, 2002

(65) Prior Publication Data

US 2002/0157584 A1 Oct. 31, 2002

(30) Foreign Application Priority Data

Apr. 27, 2001 (IT) ..... BO2001A0260

(51) Int. Cl.[7] ..... D05B 11/00; B68G 7/12

(52) U.S. Cl. ..... 112/2.2; 29/91.4

(58) Field of Search ..... 112/2.2, 2.1, 470.27; 29/91.4, 91.2, 91.3; 5/696

(56) References Cited

U.S. PATENT DOCUMENTS 2,087,847 A * 7/1937 Morley ..... 112/2.2

2,192,161 A * 2/1940 Fridolph ..... 5/696

FOREIGN PATENT DOCUMENTS

| | | |
|---|---|---|
| EP | 0 844 210 | 5/1998 |
| EP | 1 167 279 | 1/2002 |
| WO | 98 04495 | 2/1998 |

* cited by examiner

*Primary Examiner*—Peter Nerbun

(74) *Attorney, Agent, or Firm*—Guido Modiano; Albert Josif; Daniel O'Byrne

(57) ABSTRACT

An apparatus for inserting through a mattress tufting straps having a frame for locking said mattress, a device for inserting the tufting straps through the mattress, supported by the frame, and actuators for actuating the device to move above the mattress. The inserting device includes a magazine for tufting straps, a needle with a tip receptacle for receiving and transferring a clip through the mattress, a transfer element, with a seat for receiving the clip, and a pusher, movable transversely to the needle for engaging the clip and inserting the clip in the tip receptacle.

19 Claims, 15 Drawing Sheets

APPARATUS FOR INSERTING TUFTING STRAPS IN A MATTRESS

BACKGROUND OF THE INVENTION

The present invention relates to an apparatus for inserting tufting straps in a mattress.

It is known that mattresses, in order to restrain the external padding and prevent excessive expansion due to the compression of the internal springs and of the filling material, are kept flat by a plurality of retention elements, known as tufting straps, one of which is shown for the sake of clarity in FIG. 1. As shown in the figure, the tufting strap is designated by the letter P and is constituted by a tension element T, which consists of a tape provided, at its opposite ends, with clips $S_1$, $S_2$ that are suitable to abut, in the active position, against disks $D_1$, $D_2$ detailed hereinafter in order to keep the mattress substantially flat.

Currently, the tufting straps are inserted with predominantly manual methods, which entail excessively long times and high costs.

SUMMARY OF THE INVENTION

The aim of the present invention is to provide an apparatus that allows to automate the application of tufting straps.

Within this aim, an object of the invention is to provide an apparatus that has a simple structure, is relatively easy to provide in practice, safe in use, effective in operation, and has a relatively low cost.

This aim and this and other objects which will become better apparent hereinafter are achieved with an apparatus whose characteristics are defined in the appended claims.

BRIEF DESCRIPTION OF THE DRAWINGS

Further characteristics and advantages will become better apparent from the following detailed description of a preferred but not exclusive embodiment of an apparatus for inserting tufting straps in a mattress, illustrated only by way of non-limitative example in the accompanying drawings, wherein.

DESCRIPTION OF THE PREFERRED EMBODIMENTS

Figure 1:
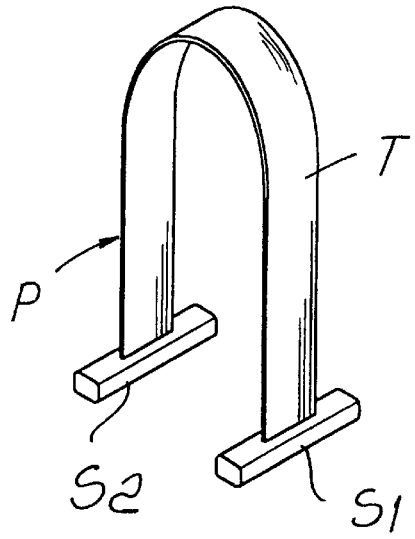
FIG. 1 is a perspective view of a tufting strap.
Figure 2:
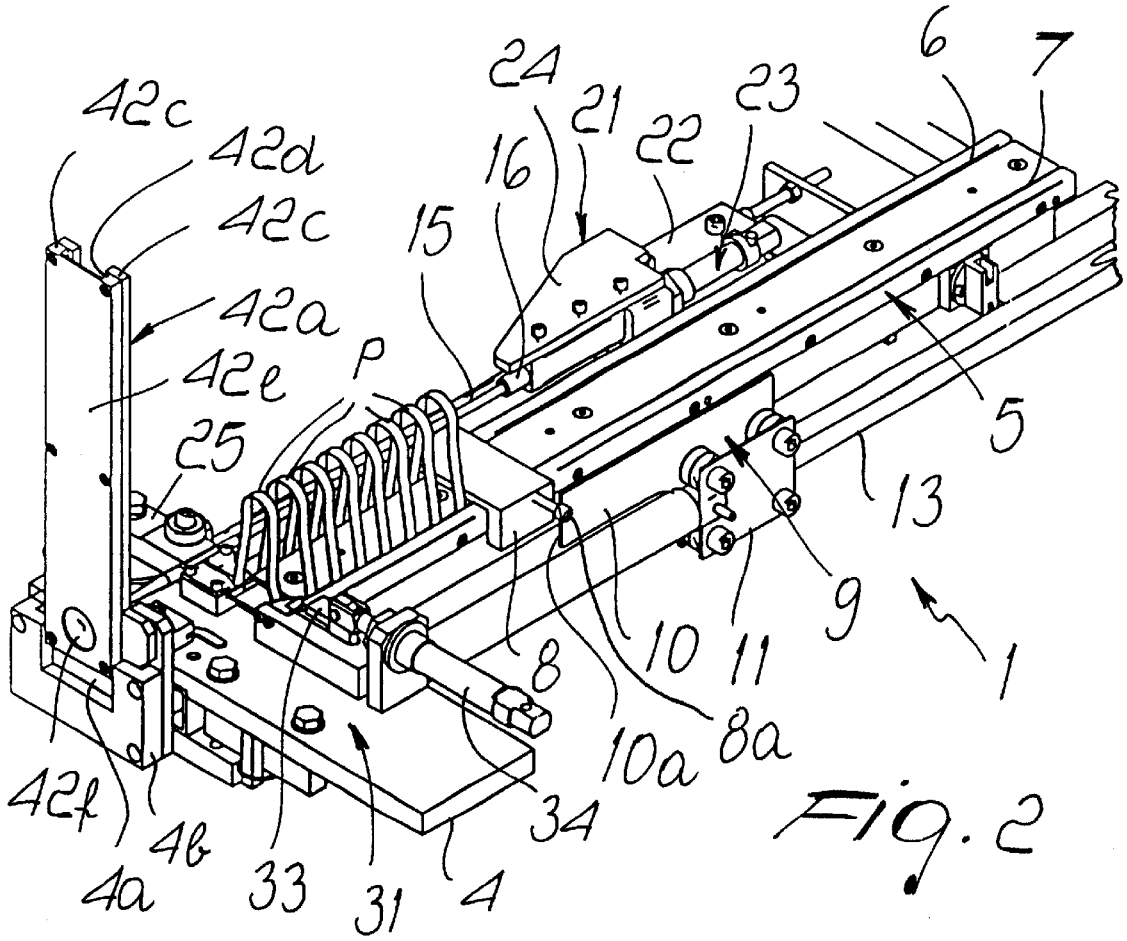
FIG. 2 is a perspective view of a device of the apparatus according to the invention.
Figure 3:
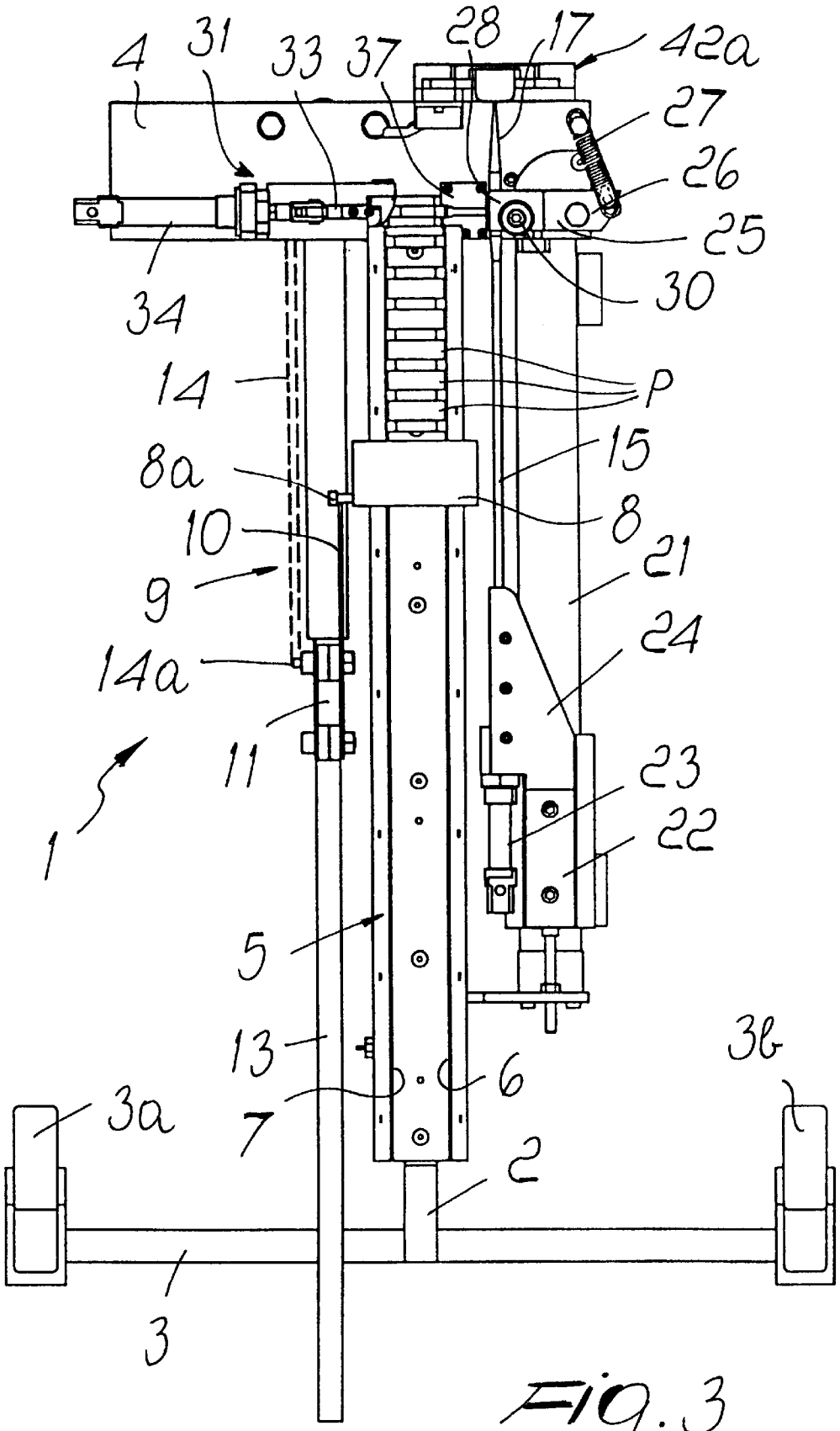
FIG. 3 is a plan view of the device of FIG. 1.
Figure 4:
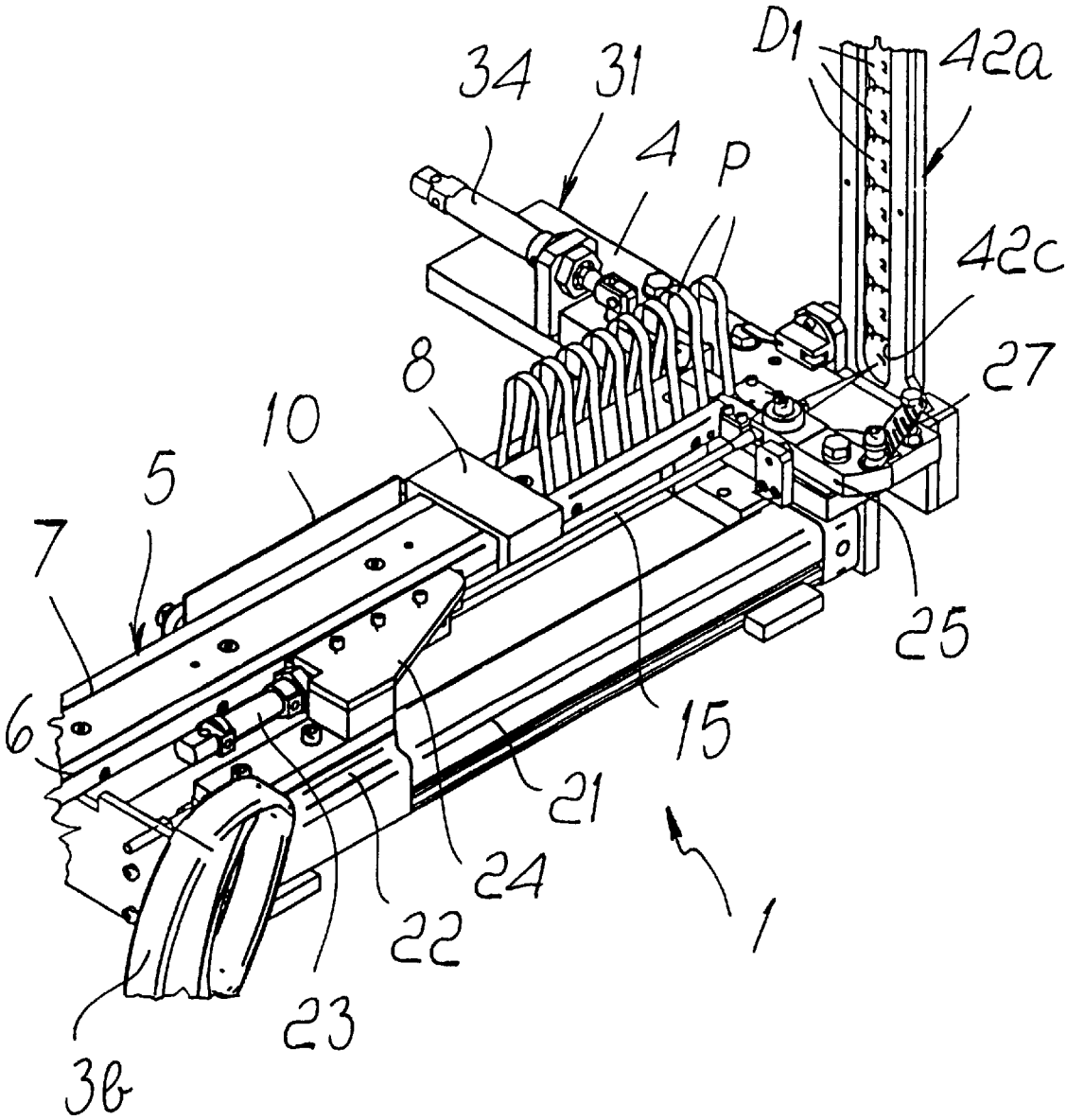
FIG. 4 is a perspective view of the device from another viewpoint.
Figure 5:
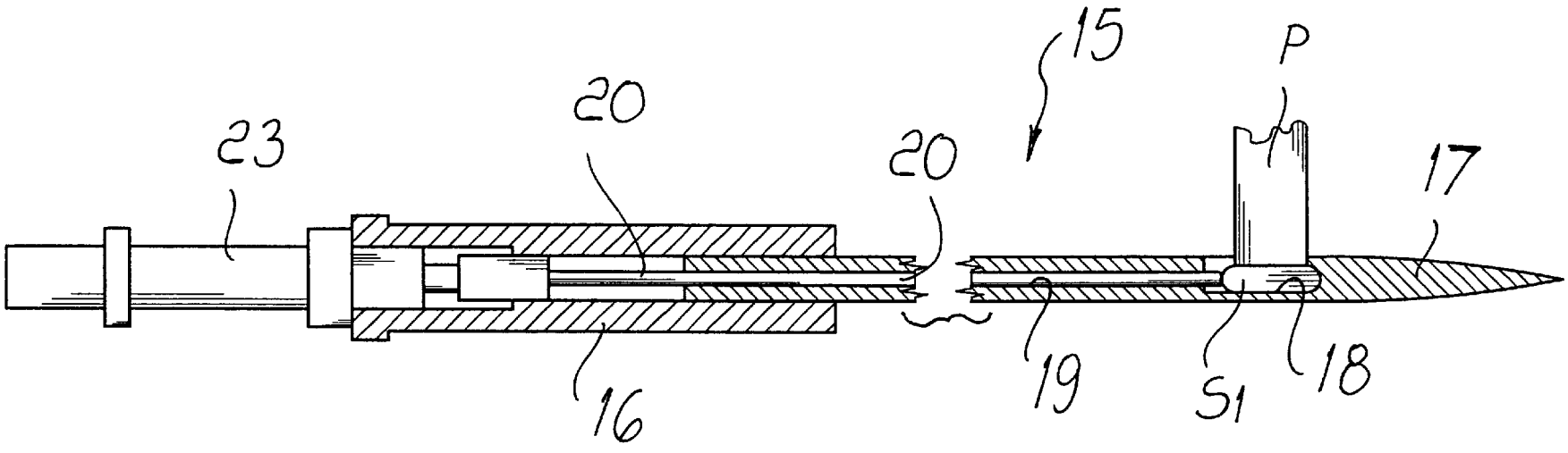
FIG. 5 is a sectional view of the needle.
Figure 6:
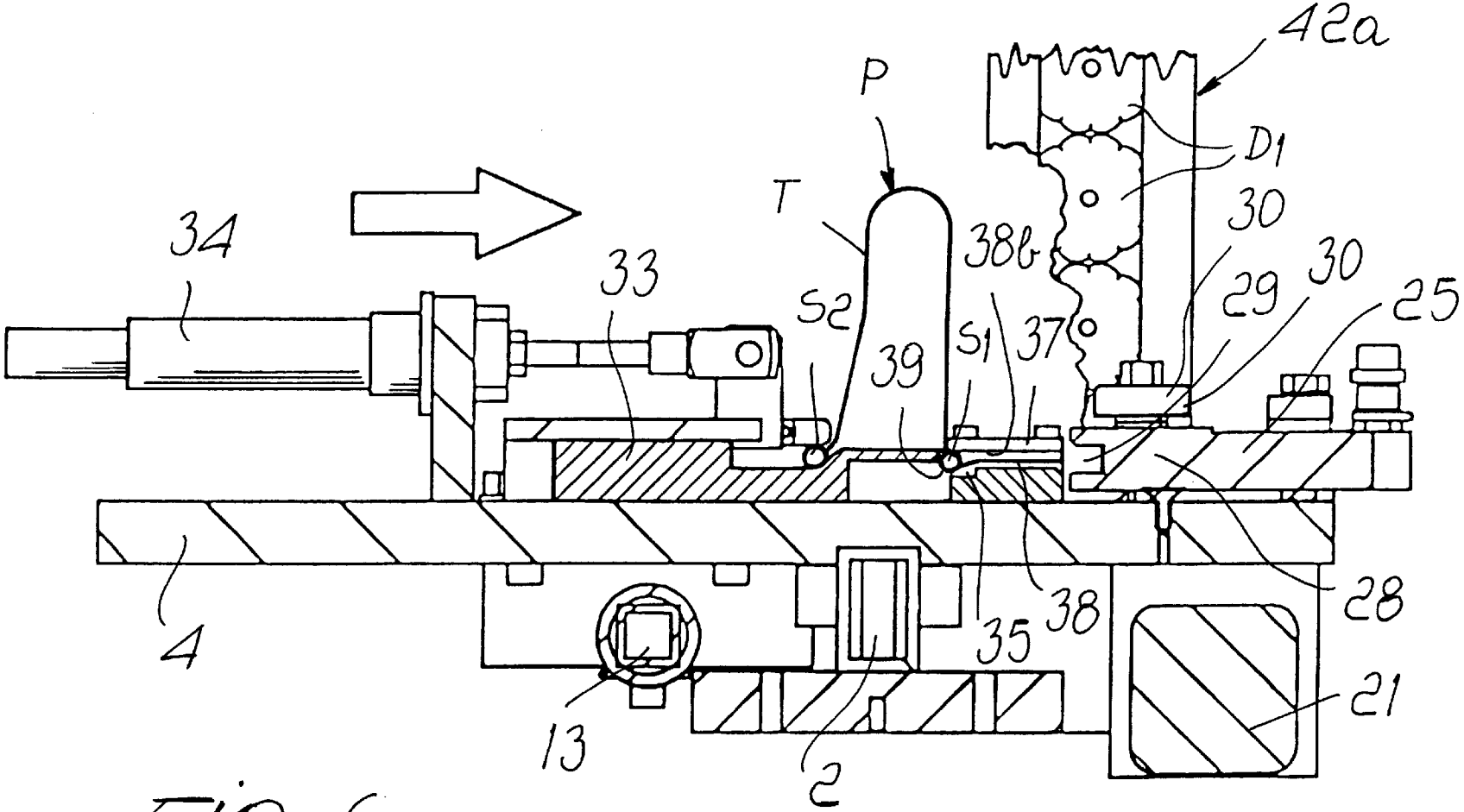
FIG. 6 is a view, in a section along a plane at the transfer element.
Figure 7:
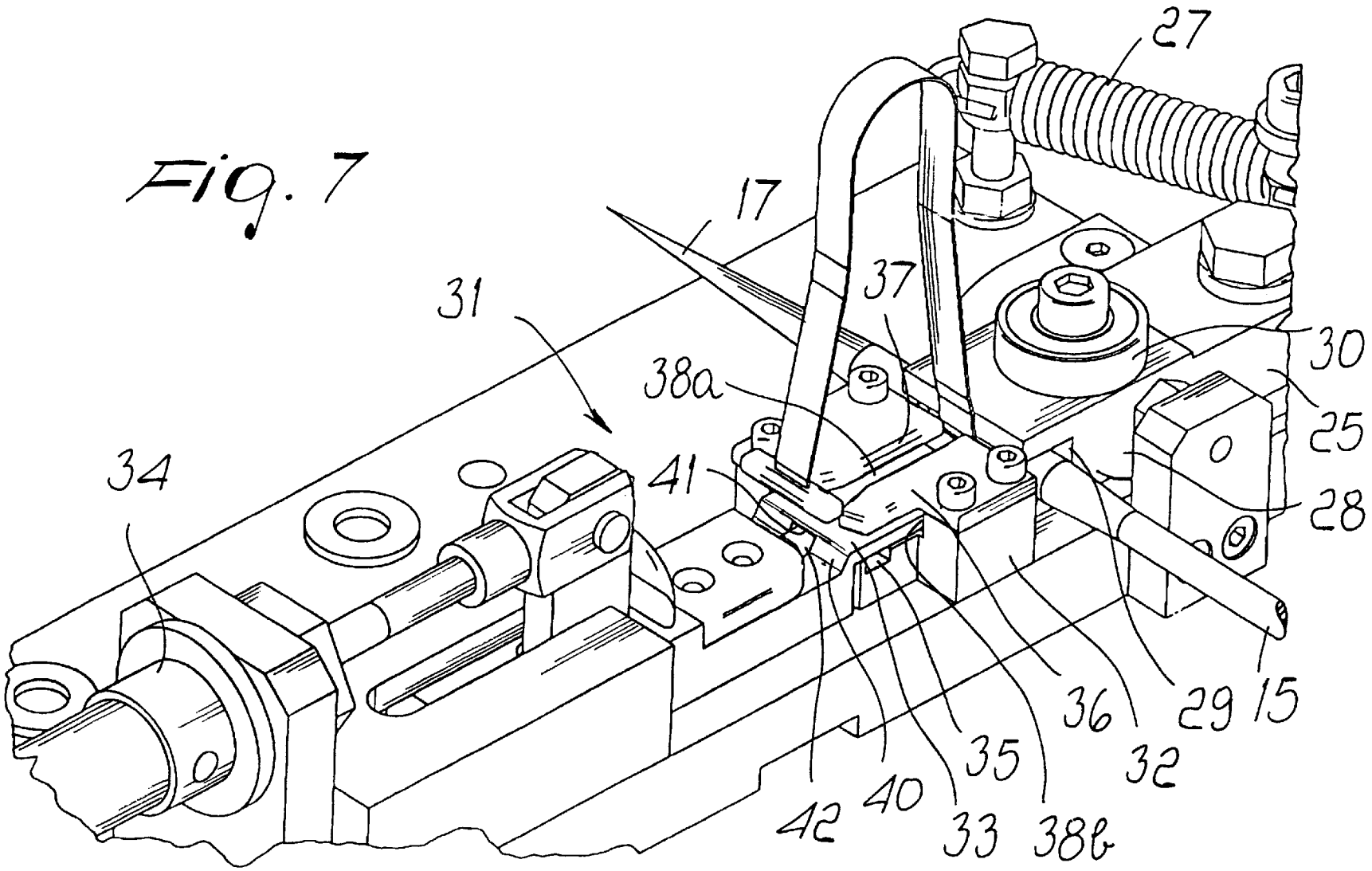
FIG. 7 is a perspective view of the transfer element.
Figure 8:
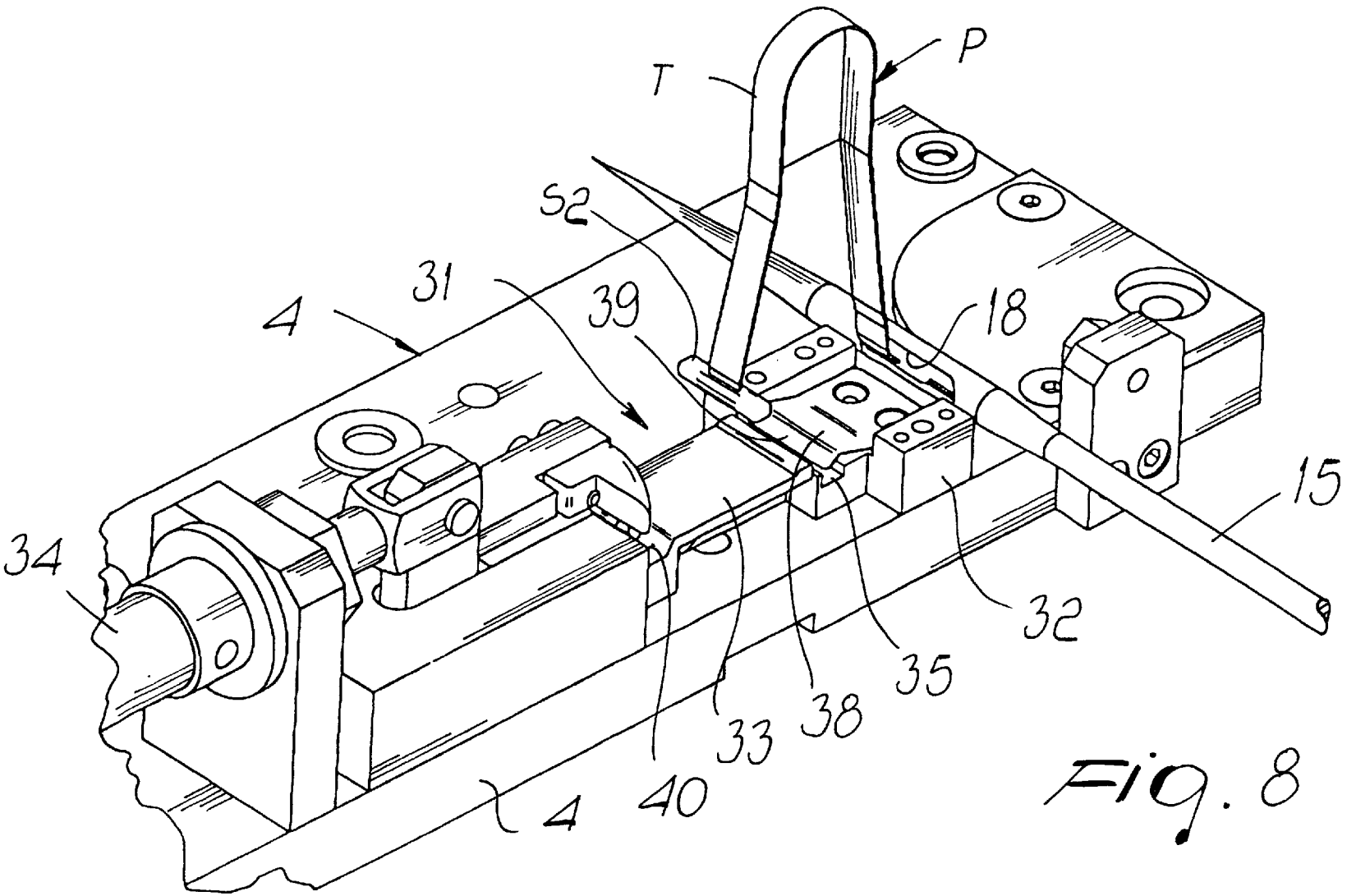
FIG. 8 is a perspective view, with some components removed in order to better illustrate some constructive details.

With particular reference to FIGS. 2 to 8, the reference numeral 1 generally designates a device of the apparatus that inserts the tufting straps P through a mattress M.

Figure 12:
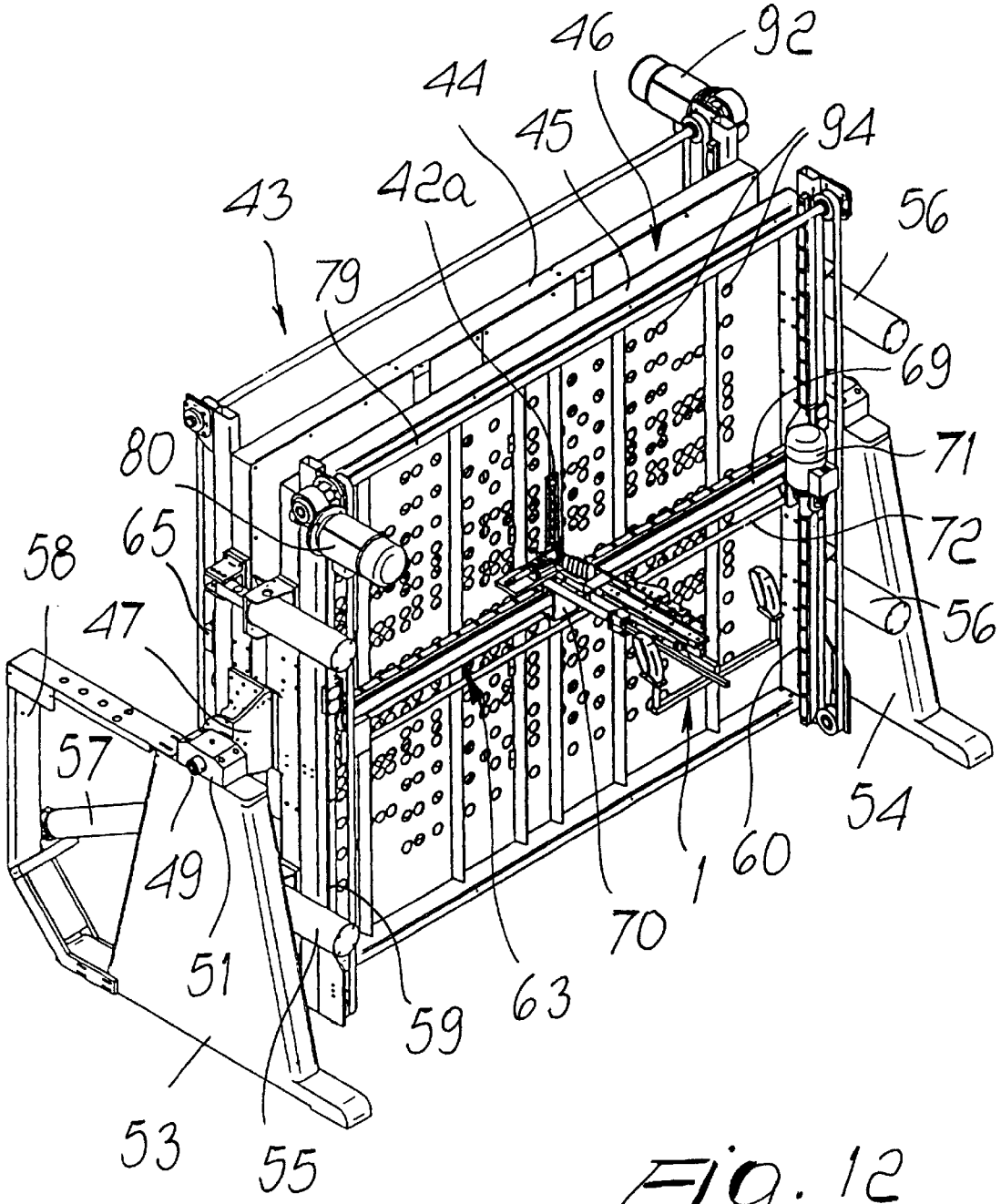
FIG. 12 is a perspective view of the apparatus in which the device of FIGS. 1 to 9 is installed.
Figure 13:
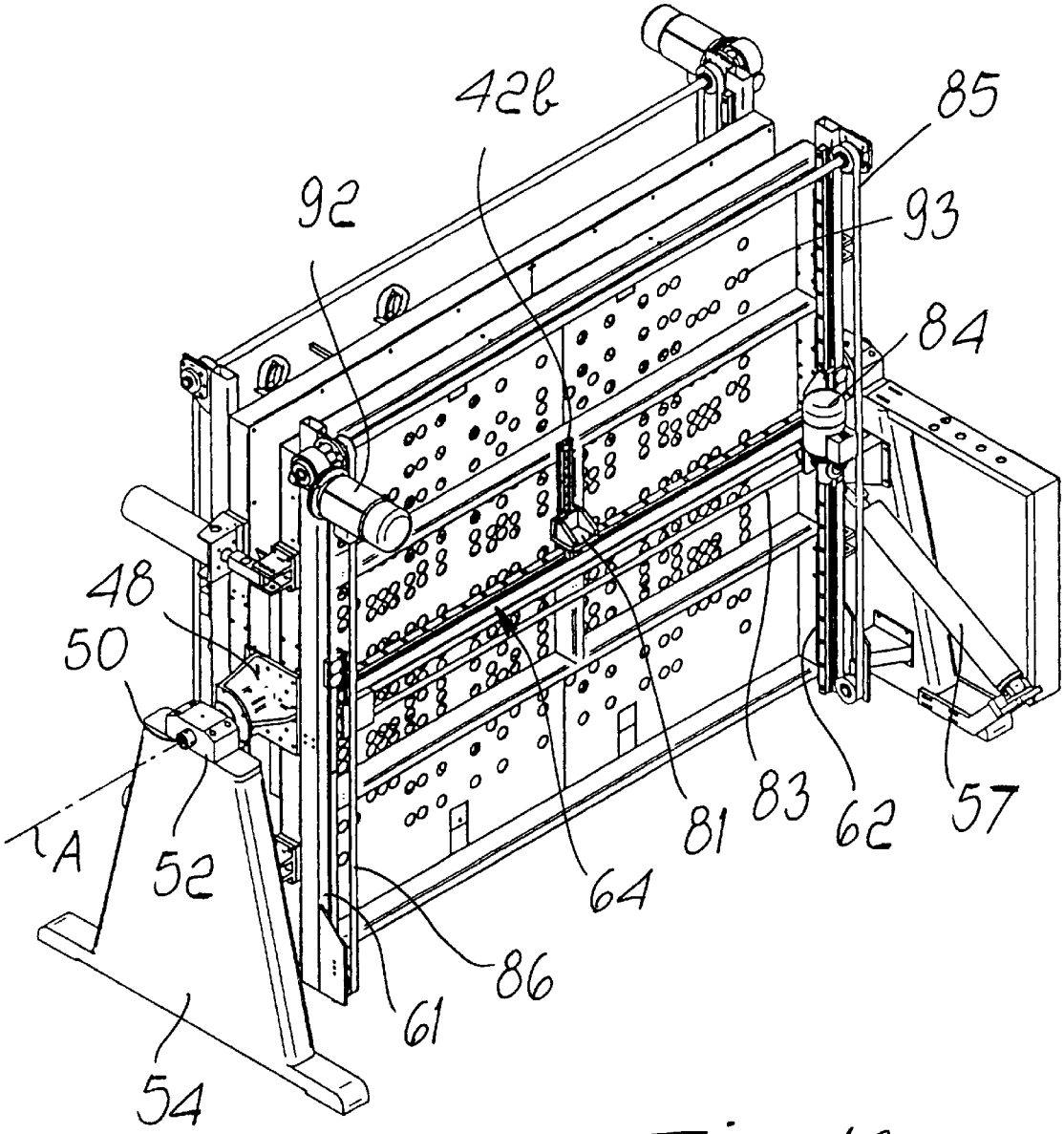
FIG. 13 is a perspective view of the apparatus, as seen from the opposite side with respect to FIG. 12.

The device 1 (whose position with respect to the mattress is shown more clearly in FIG. 12) comprises a central supporting beam 2, to the ends of which a cross-member 3 (see FIG. 3) and a plate 4 are fixed. The cross-member 3 is provided with handles 3*a* and 3*b* so as to provide a handlebar for maneuvering the device.

Figure 9:
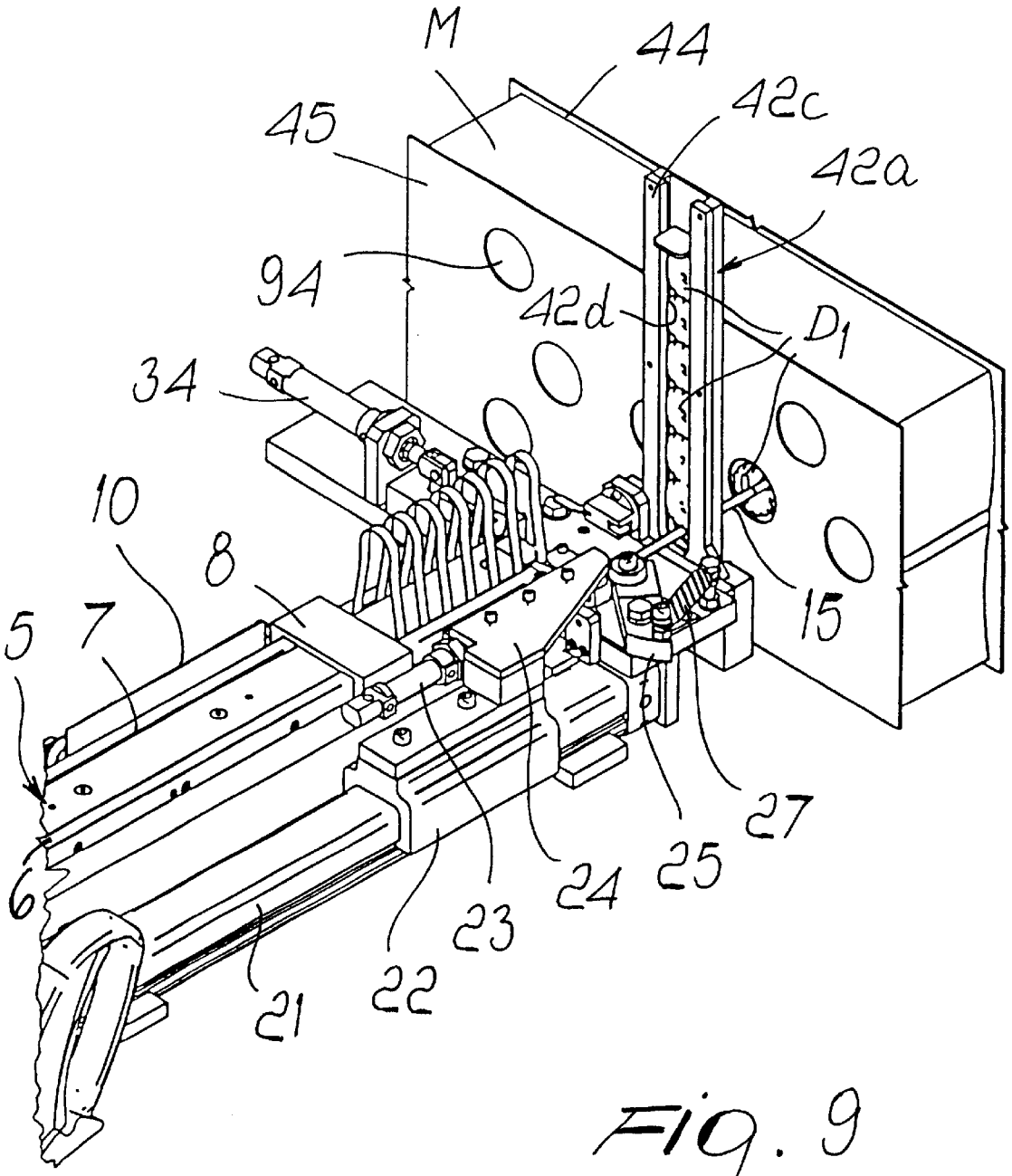
FIG. 9 is a perspective view of the device in a first operating condition.
Figure 10:
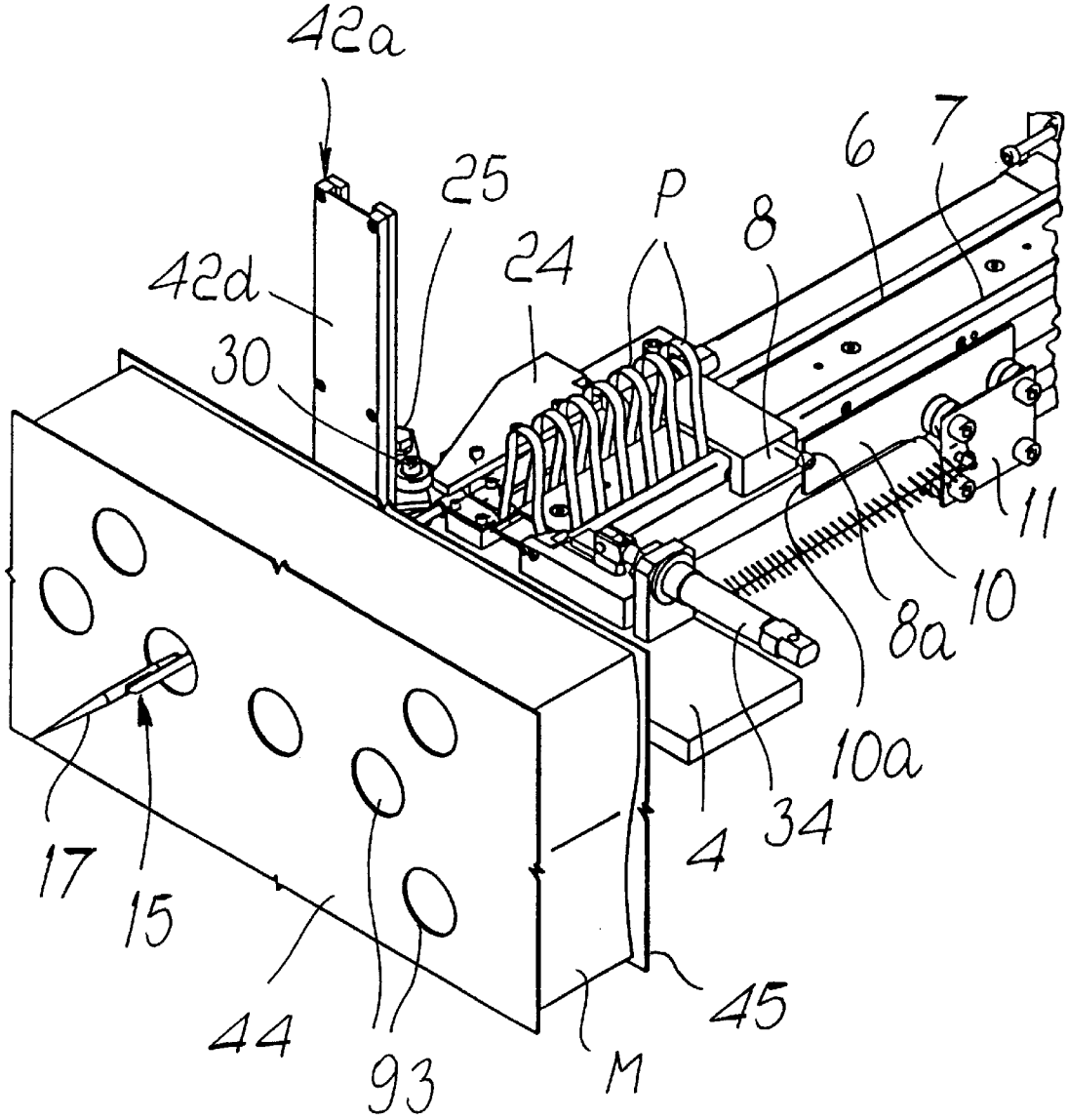
FIG. 10 is a perspective view of the device as seen from the opposite side with respect to FIG. 9.
Figure 11:
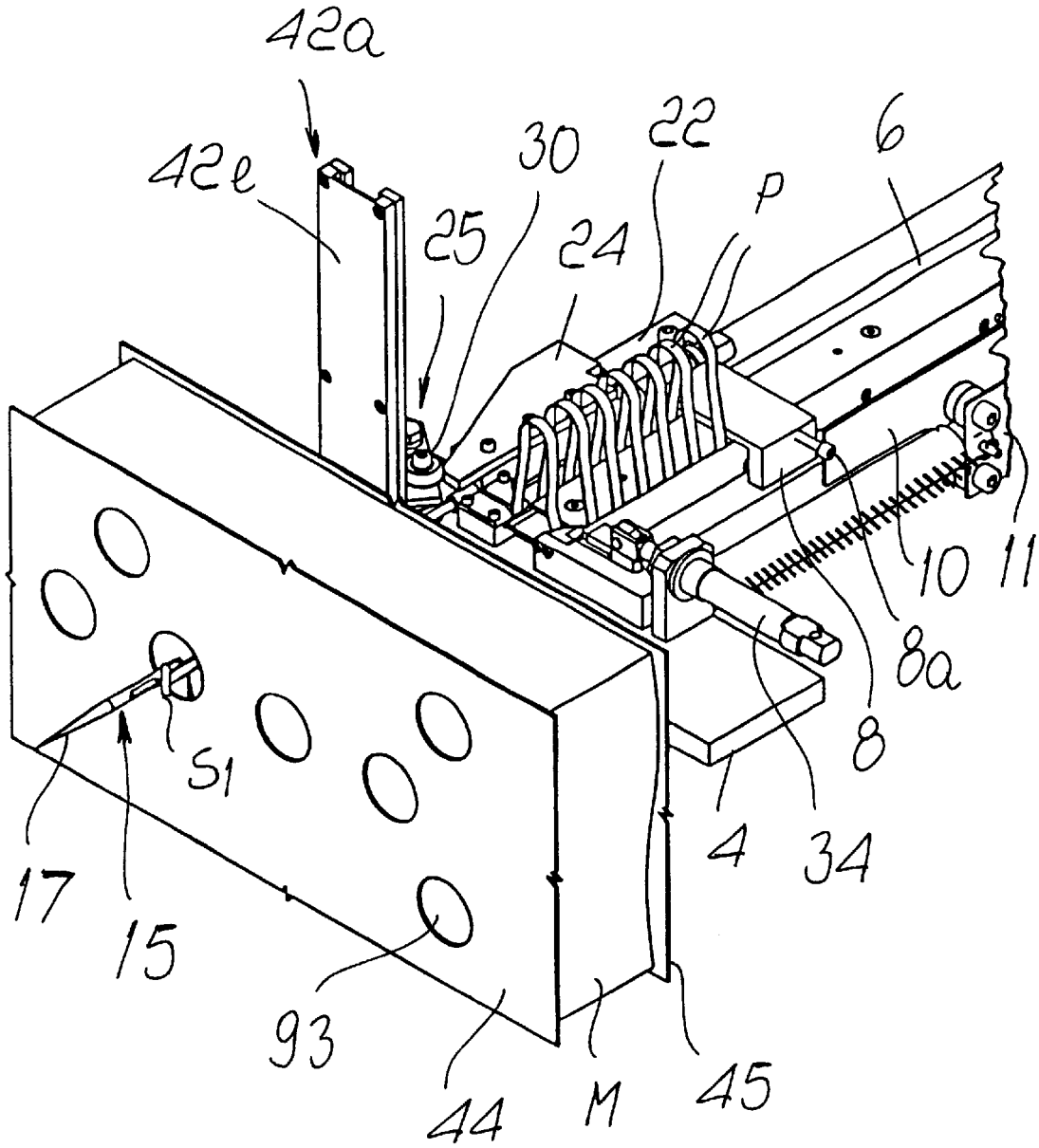
FIG. 11 is a perspective view of the device in an operating condition that occurs after the one shown in FIGS. 9 and 10.

A tufting strap magazine 5 is fixed to the beam 2 and has two slots 6 and 7 that slidingly accommodate the clips $S_1$, $S_2$ of each tufting strap P. The tufting strap magazine 5 comprises a magazine pusher 8, which is constituted by a sort of saddle, is arranged downstream of the plate 4, as shown more clearly in FIG. 9, and causes, by way of the actuation means 9, the clips $S_1$, $S_2$ to slide toward the mattress M. The actuation means 9 comprise a lamina 10, which frontally engages, by means of the vertical side 10*a*, a pin 8*a* that is rigidly coupled to the pusher 8. The lamina is rigidly coupled to a slider 11, which can slide on a rail 13, which is parallel to the beam 2 and is fixed by means of its opposite ends to the plate 4 and to the cross-member 3. The slider 11 is actuated by a spring 14, which is connected to the slider with one end 14*a* and to the plate 4 with the other end. The spring 14 applies to the slider 11 an elastic force toward the plate 4, which allows the pusher 8 to make the tufting straps P advance toward the mattress M.

Adjacent to the tufting strap magazine 5, the device 1 comprises a tubular needle 15 (see FIG. 5), in which one end is fixed in a sleeve 16 and the opposite end has a tip 17 provided with a receptacle 18 suitable to receive the first clip $S_1$ through a lateral opening by means of a transfer element 31 described hereinafter.

The receptacle 18 is connected to the internal cavity 19 of the needle, in which a rod 20, suitable to lock the first clip $S_1$ inside the seat, can slide.

The needle 15 is guided at right angles with respect to the mattress M by first means for actuation between a first position, in which the tip 17 is arranged upstream of the mattress M and the first clip $S_1$ is retained in the receptacle 18 by the rod 20, and a second position, in which the tip 17 has pierced the mattress M and the rod 20 releases the clip $S_1$ downstream of the mattress M. Said first actuation means comprise a linear actuator 21, which is fixed, by means of its opposite ends, below the plate 4 and the beam 2. The actuator 21 actuates a carriage 22, on which the sleeve 16 and a cylinder 23 for actuating the rod 20 are mounted.

A cam 24 is rigidly coupled to the carriage 22 and has an edge that is inclined with respect to the carriage advancement direction.

Proximate to the tip 17 of the needle 15, the plate 4 supports, so that it can rotate about a vertical rotation axis, a rocker 25 (see FIGS. 4 and 6), in which one end 26 is connected, by means of a spring 27, to the plate 4 and the other end 28 forms a guiding recess 29 for the needle 15. A free roller 30 is arranged on the end 28 and is suitable to be detachably engaged by the cam 24. The function of the rocker 25 is to contrast the possible flexing of the needle when the clip $S_1$ is inserted in the receptacle 18, while the cam 24 is meant to remove the abutment provided by the rocker 25 when the needle 15 is made to advance toward the mattress.

A transfer element 31 (see FIGS. 6 to 8) is provided between the mattress M and the output of the magazine 5 and is supported by the plate 4. The transfer element 31 comprises a transfer pusher 33, which is actuated by a fluid-actuated cylinder 34 and is arranged opposite a block 32 provided with a hollow 35 suitable to receive the first clip $S_1$ that arrives from the corresponding slot 6. Above the hollow 35 there are two plates 36, 37, which are fixed onto the block 32 and are divided by a gap 38*a* that is aligned with the receptacle 18 of the needle 15. Between the plates 36, 37 and the block 32 there remains an interspace or channel 38*b*, in which there is an elastic lamina 38 provided with a U-shaped edge which is accommodated in the hollow 35 and forms a seat 39 that is aligned with the slot 6 in order to receive the clip $S_1$ and retain it under the plates 36, 37. The pusher 33 has a second seat 40, which is centrally provided with a passage opening 41 suitable to be engaged by a tooth 42 that protrudes from the block 32. The seat 40 is aligned with the slot 7 in order to receive the second clip $S_2$. The pusher 33, by means of the cylinder 34, can move transversely with respect to the needle 15, so as to transfer the first clip $S_1$ from an initial position (in which it is locked elastically in the seat 39 by the lamina 38) through the channel 38*b* to a final position for insertion in the receptacle 18 of the needle. Once the clip has been transferred into the receptacle 18, the tooth 42 disengages the second clip $S_2$ from the corresponding retention seat 40.

Two magazines 42*a* and 42*b* for the disks $D_1$, $D_2$ (see FIGS. 6 and 10 to 13) are associated with the device 1. The magazine 42*a* is constituted by a sort of case, which can be inserted removably in a seat 4*a* (see FIG. 2) provided in an element 4*b* associated with the plate 4.

The case 42*a* is formed by two parallel strips 42*c*, provided with mutually opposite slots 42*d* and mutually connected by a wall 42*e* which, in alignment with the needle 15, has an opening 42*f*. The disks Dl are inserted from above into the slots 42*d* of the case 42*a*, forming a column in which the lower disk faces the opening 42*f*.

The opening 42*e* allows the tip of the needle 15 to pass through the disk D1 and place it on the face of the mattress M. Likewise, the other magazine 42*b* (see FIG. 13) is detachably supported on the other side of the mattress, in a region of the frame described in detail hereinafter, and has the same characteristics as the magazine described above.

The described device 1 is conveniently integrated in an apparatus for the automatic application of tufting straps onto the entire surface of the mattress M shown in FIG. 12.

Said apparatus comprises a frame, generally designated by the reference numeral 43, which is composed of two rectangular walls 44 and 45 which are flat and mutually parallel so as to delimit between them a space 46 meant to receive the mattress M. The wall 44 is provided, in a central position of two parallel sides, with two bodies 47, 48 from which two respective mutually coaxial pivots 49, 50 protrude horizontally.

The pivots 49, 50 can rotate, about the horizontal axis A, in supports 51 and 52, which are fixed to the top of two side members 53, 54 anchored to a footing for resting on the ground.

The sides of the walls 44 and 45 that are perpendicular to the axis A are spaced from the adjacent side members 53, 54 in order to allow the installation, on each side, of two jacks 55, 56, in which the cylinders are articulated to the wall 45 and the stems are rigidly coupled to the wall 44. The pairs of jacks 55, 56 allow to move the wall 45 with respect to the wall 44 in order to allow, when the walls are in a spaced position, the placement of the mattress M in the space 46 and, when the walls are in a mutually closer position, the retention of the mattress M in order to apply the tufting straps P by means of the above described device 1.

The mattress M is positioned in the space 46 while the walls 44 and 45 are in the horizontal position. For this purpose, the stem of a jack 57 is articulated to one side of the wall 44 and is pivoted, by means of its cylinder, to a frame 58 that is rigidly coupled to the side member 53. Once the mattress has been positioned in the space 46 and therefore rests on the wall 44, the jacks 55, 56 are actuated and lock it between the walls 44 and 45, reducing its thickness to a value that is smaller than the length of the tufting straps P that will be driven through it.

Figure 14:
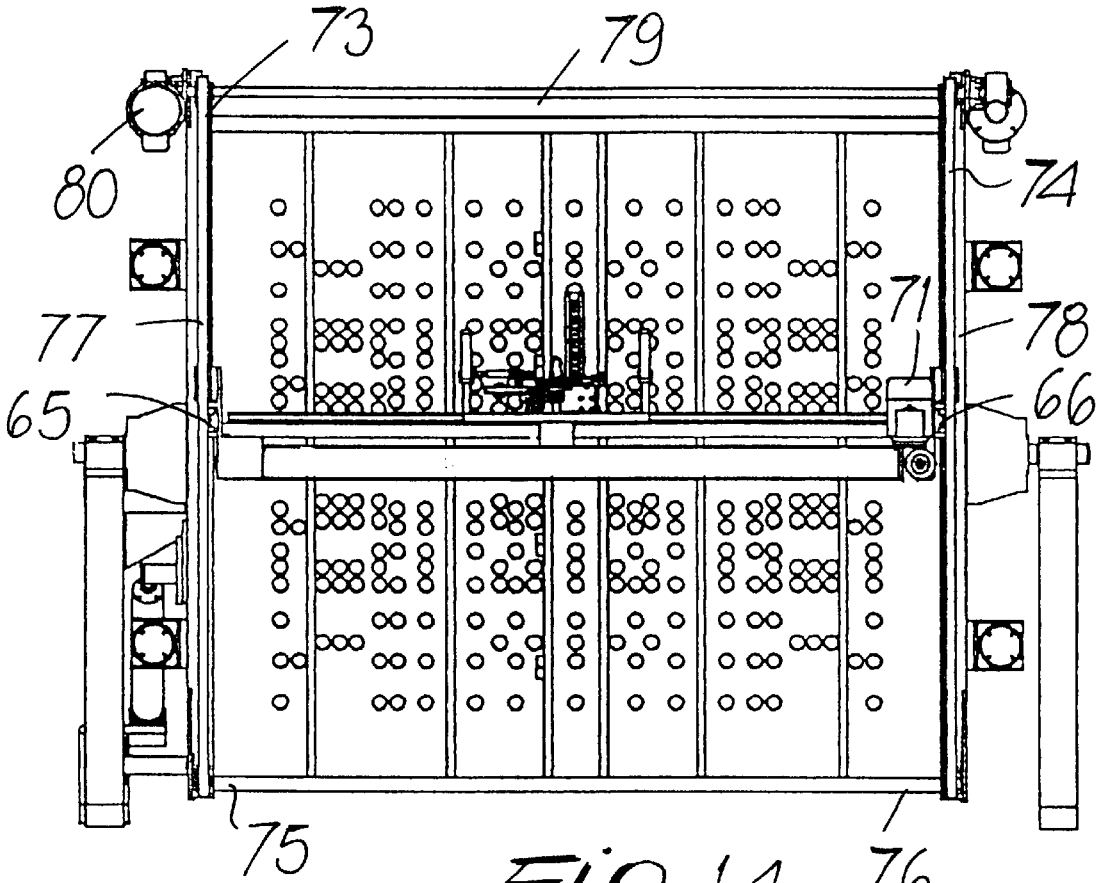
FIG. 14 is an elevation view of the apparatus, taken from the side of the device.
Figure 15:
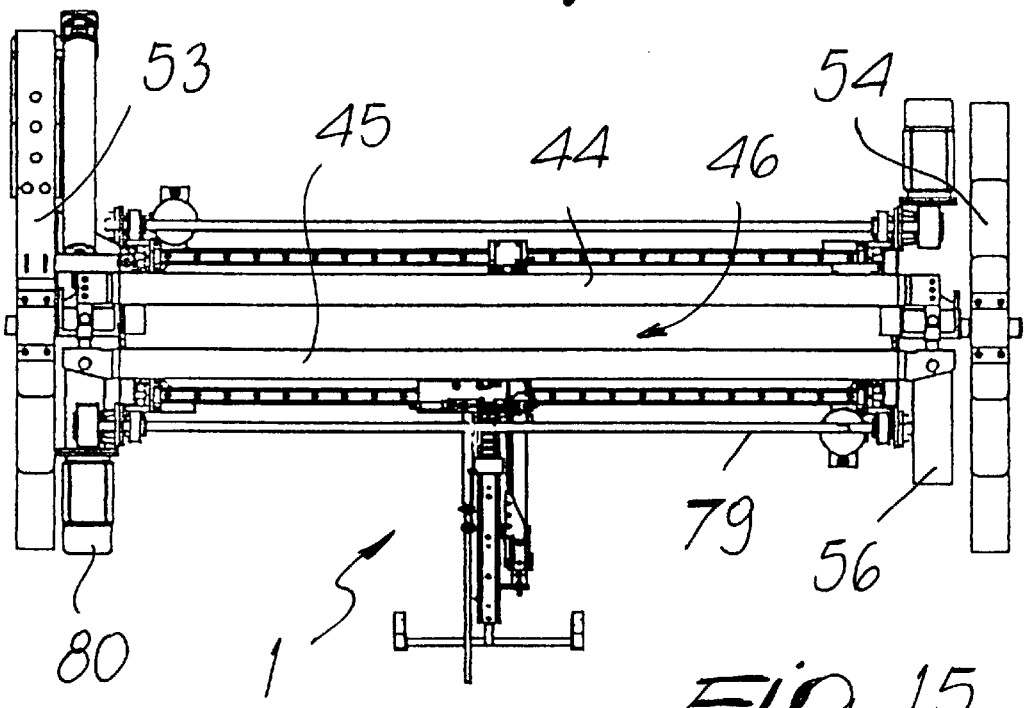
FIG. 15 is a top view of the apparatus.
Figure 17:
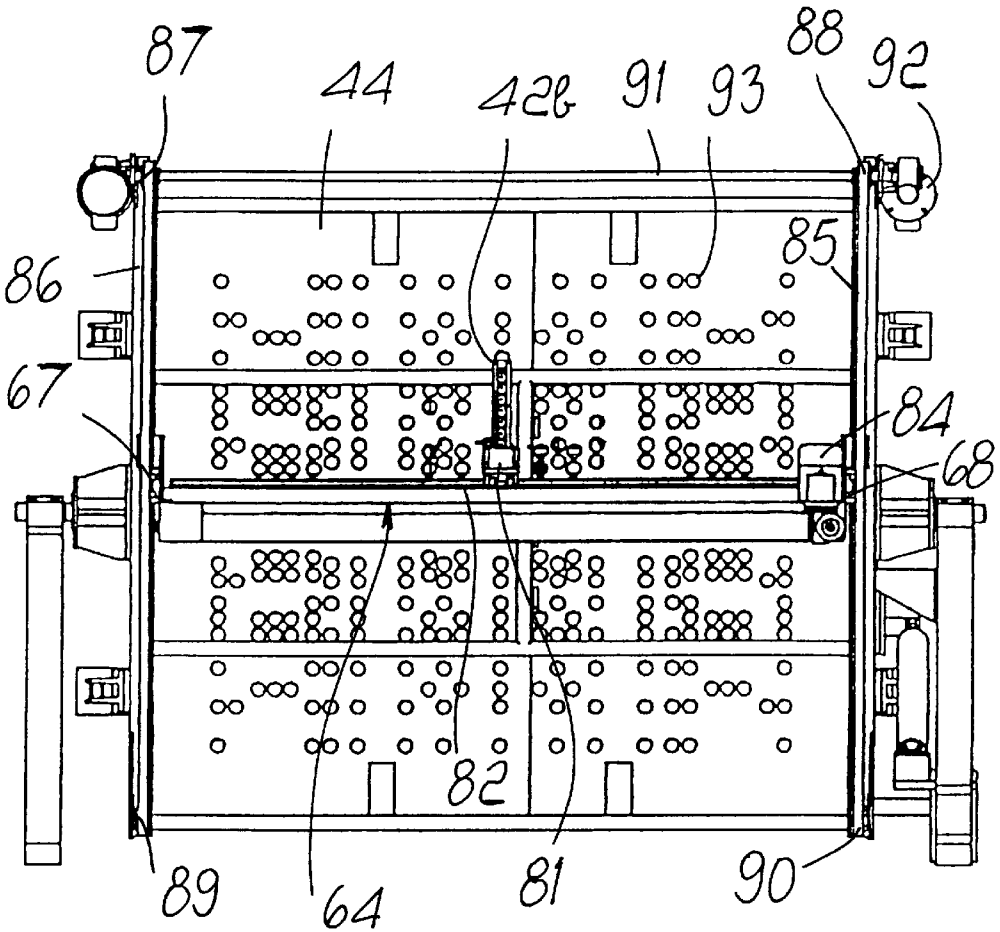
FIG. 17 is an elevation view of the apparatus, as seen from the opposite side with respect to FIG. 14.
Figure 16:
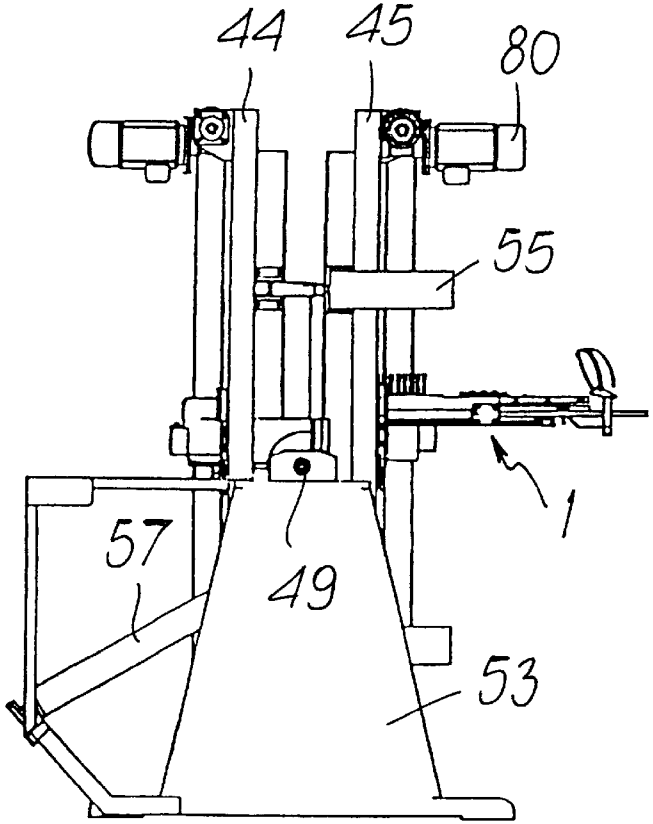
FIG. 16 is a side elevation view of the apparatus.

Respective pairs of guides 59, 60, 61, 62 (see FIGS. 12 and 13) are fixed on the sides of the walls 44, 45 that lie at right angles to the axis A, and two carriages 63, 64 can slide thereon; said carriages are substantially constituted by a beam that is parallel to the axis A and has, at its opposite end, sliding blocks 65, 66, 67, 68 (see FIGS. 14 and 17) which are slidingly rigidly coupled in the guides 59–62.

A rail 69 is fixed on the beam that constitutes the carriage 63 and allows the sliding of a slide 70 on which the plate 4 of the device 1 is fixed. The slide 70 can move along the rail 69 by means of a transmission composed of a reversible gearmotor 71, which is coupled by means of a flange to one end of the carriage 63 and on whose output shaft a toothed pulley, for the actuation of a toothed belt 72, is keyed. The belt 72 is wound in a loop around a guiding pulley, which is supported at the opposite end of the carriage 63, so that the two portions of the belt 72 are parallel to the rail 69. One of the two portions of the belt is rigidly coupled to the slide 70, so that by activating the gearmotor 71 it is possible to move the device 1 along the rail 69 in order to position it transversely on the wall 45.

In order to position the device 1 at right angles to the axis A, at the corners of the wall 45 there are two pairs of pulleys 73, 74 and 75, 76 (see FIGS. 12 and 14), around which two respective toothed belts 77, 78 are wound which run parallel to the rails 59, 60. The pulleys 73, 74 are rotationally coupled to each other by means of a shaft 79, which receives its motion from a gearmotor 80 of the reversible type, which is coupled by means of a flange laterally to the wall 45. The sliding blocks 65, 66 are rigidly coupled to a portion of the belts 77 and 78, so that the carriage 63, by actuating the gearmotor 80, can move along the rails 59, 60 while remaining parallel to the axis A.

In order to move the carriage 64 with respect to the wall 44, there are elements that are fully identical to the ones described above to illustrate the movement of the carriage 63 with respect to the wall 45.

These elements (see FIG. 13) comprise a slide 81, on which the magazine 42*b* of the disks $D_2$ is fixed; said slide can slide on a rail 82, which is fixed to the beam that constitutes the carriage 64. The slide 81 can be moved along the rail 82, and therefore parallel to the axis A, by means of a belt 83 actuated by a reversible gearmotor 84 mounted on the carriage 64.

In order to move the carriage 64 at right angles to the axis A, the sliding blocks 67, 68 are connected to two belts 85, 86 (see FIGS. 13, 17), which are parallel to the rails 61, 62 and are wound around respective pairs of pulleys 87, 88 and 89, 90, which are rotatably supported at the corners of the wall 44; the pulleys 87, 88 are rotationally connected by a shaft 91, which is actuated by a reversible gearmotor 92.

The walls 44, 45 are provided with a plurality of holes 93, 94, through which the device 1 drives the tufting straps P through the mattress M.

The holes 93 of the wall 44 are arranged perfectly opposite with respect to the holes 94 of the wall 45, and their placement is determined substantially as a function of a uniform distribution of the tufting straps P with respect to the dimensions of the mattress M, although the choice of the tufting strap application points can follow various criteria.

Since, as will become better apparent from the description that follows, respective disks $D_1$, $D_2$ are arranged between the opposite faces of the mattress M and the clips $S_1$, $S_2$ of the tufting straps, the disk $D_1$, taken from the magazine 42*a* of the device, must be perfectly aligned with the disk $D_2$ that is taken from the magazine 42*b* that lies behind the wall 44 and therefore there must be perfect synchronization of direction, orientation and modulus of the movements performed by the magazines 42*a* and 42*b*, and therefore ultimately of the slide 70 that supports the device 1, with the magazine 42*a* and the slide 81 that supports the magazine 42*b*.

For this purpose, the gearmotors 80, 92 and 71, 84 that actuate the carriages 63 and 64 and the slides 70 and 81 are controlled by a control unit, which controls their synchronized movements according to a predetermined and presettable program. The same program controls the elements that determine the activation of the actuator 21 for the advancement of the needle supporting carriage 22 and of the cylinders 34, 23 that actuate the transfer and retention of the clip $S_1$ of the tufting strap P in the receptacle 18 of the tip of the needle 15.

The operation of the illustrated apparatus, albeit fully evident from the provided description, is as follows.

Starting from a situation in which the walls 44, 45 are arranged horizontally and are mutually spaced at a distance that is greater than the thickness of the mattress M, said mattress is inserted in the space 46. Once the placement of the mattress has been completed, the four jacks 55, 56 are actuated and, by moving the walls 44 and 45 toward each other, compress the mattress to a thickness that is smaller than the length of the tufting straps P.

After the walls 44, 45 have assumed the vertical position shown in FIGS. 12–17 as a consequence of the activation of the jack 57, the actuation of the gearmotors 80, 92 and 71, 84 determines the movement of the slides 70, 81 into the position for alignment with the holes 93, 94 of the walls 44, 45, in which a tufting strap P is to be inserted. At this point, the cylinder 34 is activated and, by acting with the pusher 33 on the clip $S_1$, transfers said clip from the seat 39 through the channel 38*b* into the receptacle 18 of the needle 15, where it remains because it is retained by the thrust applied by the rod 20 due to the cylinder 23. It should be noted that during the passage of the clip $S_1$ in the channel 38*b*, the tension element T passes through the gap 38*a*. When the pusher 33 moves, the second clip $S_2$ is pushed out of the seat 40 due to the thrust applied thereto by the tooth 42 through the opening 41.

Upon completion of the transfer of the clip $S_1$ from the seat 39, in which it was retained by the laminar spring 38, into the receptacle 18 of the needle 15, the actuator 21 is activated and pushes the needle 15 through the disk D1 of the magazine 42*a* and, by continuing its stroke, through the holes 93, 94 of the walls 44, 45 and of the interposed mattress M. The movement of the needle 15 is sized so that before said needle reaches the end of its stroke the clip $S_2$ engages against the disk of the magazine 42*a*, so that with the subsequent movement the disk $D_1$ is extracted from the magazine and moved into abutment against the adjacent face of the mattress, remaining clamped between said face and the clip $S_2$. When the needle, after passing through the mattress M and the disk $D_2$ contained in the magazine 42*b*, exits from the opposite side (see FIG. 10), the cylinder 23 is activated and retracts the rod 20 that lies inside the needle, releasing the clip $S_1$, which by means of the subsequent return stroke of the needle protrudes from the receptacle 18. It should be noted that as mentioned, since the mattress has been compressed down to a thickness that is smaller than the length of the tufting strap P, said tufting strap remains loose (see FIG. 11) until the mattress is removed after completion of the application of all the tufting straps and the spacing of the walls 44, 45.

The operating steps for the insertion of the tufting straps are repeated for each tufting strap in the manner described above, following the preset program.

The described invention is susceptible of numerous modifications and variations, all of which are within the scope of the same inventive concept. In particular, a partially automated solution provides for the application of the disks $D_1$, $D_2$ only on one side. In this case, while the application of the disks $D_1$ is performed according to the program with the device 1, application of the disks $D_2$ is completed manually. Naturally, the apparatus will have a simplified structure due to the absence, on the wall 44, of the magazine 42*b* and of the elements meant to move it.

Figure 18:
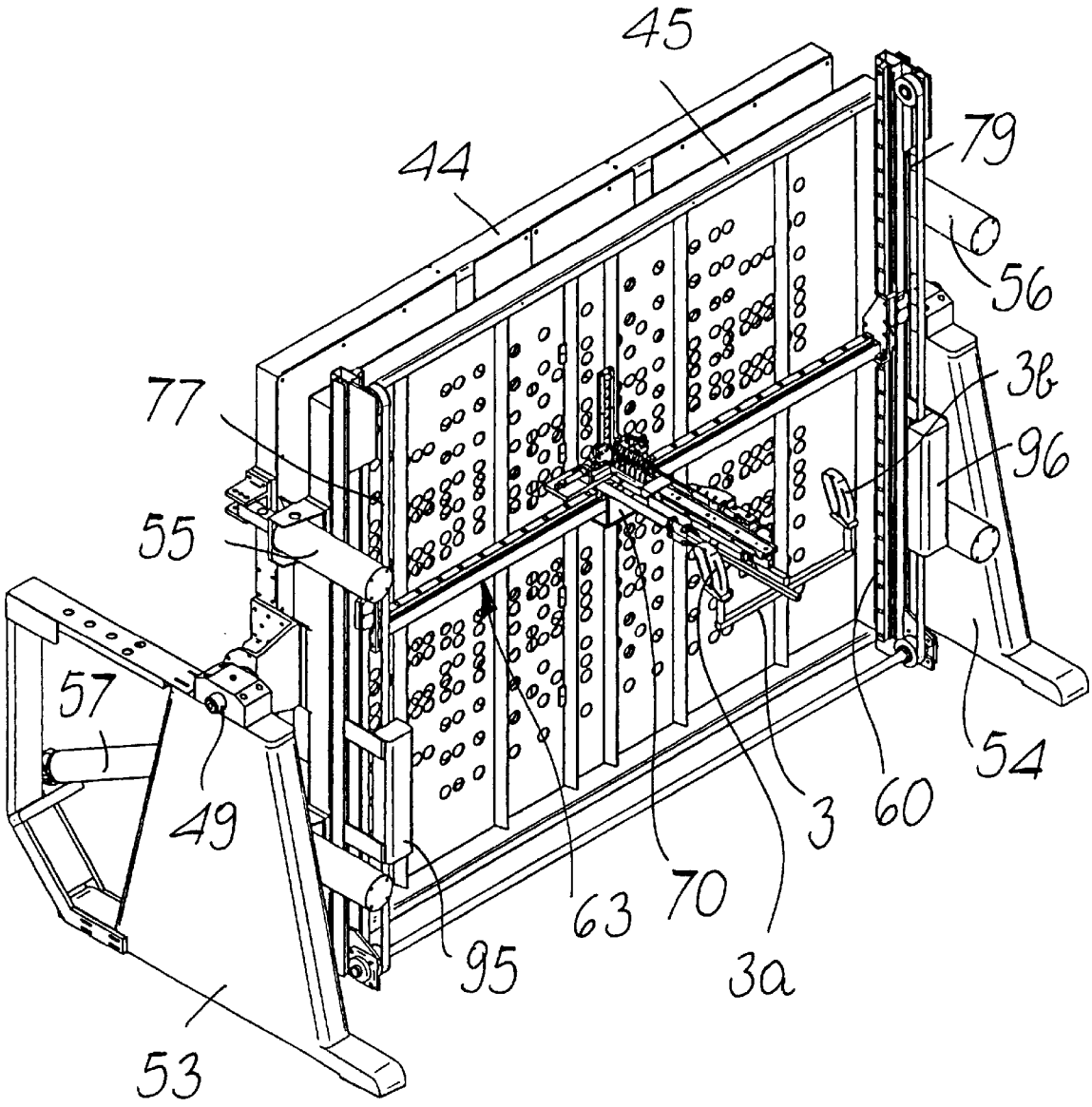
FIG. 18 is a perspective view of another embodiment of the apparatus.

Another cheaper embodiment of the apparatus, shown in FIG. 18, provides for manual actuation of the device 1. In this case, the gearmotors 71, 80 are not present and the slide 70 is actuated manually by the user by gripping the handlebar 3, 3*a*, 3*b* that is fixed to the end of the beam 2 and by moving the device 1 horizontally, making the slide 70 slide along the rail 69, and vertically, making the carriage 63 slide along the rails 59, 60. Advantageously, one pair of pulleys 75, 76 is connected by a shaft 79, and on the belts 77, 78 there are counterweights 95, 96 suitable to counterbalance the weight of the carriage 63 and of the elements mounted thereon.

In another embodiment of the invention, the means for transmitting motion from the gearmotors 80, 92 and 71, 84 to the carriages 63, 64 and to the slides 70, 81 can be constituted by worm screws.

The disclosures in Italian Patent Application No. BO2001A000260 from which this application claims priority are incorporated herein by reference.

What is claimed is:

1. An apparatus for inserting, through a mattress, retention elements consisting of a flexible tension element provided, at its opposite ends, with two clips arranged in a T-shaped configuration with respect to said tension element, and constituting tufting straps, and a first disk and a second disk, the tufting strap abutting by way of said first and second disks against the opposite faces of said mattress, the apparatus comprising: a frame for locking said mattress; an inserting device for inserting said tufting straps through said mattress which is supported by said frame; actuation means for actuating said inserting device so as to move above the mattress according to a predetermined path, and wherein said inserting device comprises: a magazine for tufting straps which has two slots for slidingly accommodating the clips of each one of said tufting straps; a needle having a tip provided with a receptacle adapted to receive a first one of said clips; first actuation means, said needle being guided at right angles to said mattress by action of said first actuation means between a retracted position, in which said tip is arranged upstream of said mattress, and an advanced position, in which said tip has passed through said mattress in order to release said first clip; a transfer element, arranged at an output of said slots, said transfer element including a seat for receiving said first clip, upon arrival from a corresponding one of said slots; second actuation means; and a transfer pusher which is movable transversely to said needle by action of second actuation means between an initial position for engagement on said first clip arranged in said clip receiving seat and a final position for insertion of said first clip in said receptacle, said needle being adapted to release said first clip after said tip has passed through said mattress.

2. The apparatus of claim 1, further comprising: a support constituted by a central beam, by a cross-member, and by a plate said cross-member and plate being respectively fixed at opposite ends of said central beam, said magazine being mounted on said support and rigidly coupled to said central beam, and said support being mounted on said frame so as to perform movements during which said needle remains always perpendicular to said mattress.

3. The apparatus of claim 2, wherein said transfer pusher is provided with a seat, said magazine comprising a magazine pusher and magazine pusher actuation means for actuating said magazine pusher toward said mattress in order to transfer said tufting straps into said transfer element so that said clips are arranged in said clip receiving seat of the transfer element and respectively in said seat of said transfer pusher.

4. The apparatus of claim 3, wherein said magazine pusher actuation means consist of a slider, of a rail on which said slider slides, said rail being substantially parallel to said central beam, of a lamina that is rigidly coupled to said slider, and of a spring, said magazine pusher including a pin that protrudes therefrom, said slider being drawn elastically toward said plate by said spring that is connected, with its opposite ends, to said plate and said slider, and being adapted to act on said pin.

5. The apparatus of claim 4, further comprising a fluid-actuated cylinder mounted on said carriage, and wherein said first actuation means comprise: a linear actuator, which is fixed between said plate and said central beam; a carriage that is movable by action of said linear actuator, said needle comprising a cavity that leads into said receptacle; and a rod that is slideable inside said cavity, said rod being actuated by said fluid-actuated cylinder and being adapted to lock said first clip in said retracted position of said needle and release the first clip in said advanced position.

6. The apparatus according to claim 5, further comprising a cam, and a rocker that is rotatably supported on said plate and has an end provided with a recess for guiding said needle, said rocker being controlled by said cam so that in the retracted position of said needle the receptacle of said needle is arranged in said recess in order to receive said first clip of the tufting strap pushed therein by said transfer pusher, and said rocker being adapted to provide a lateral support to said needle during transfer of said clip in said receptacle.

7. The apparatus of claim 6, further comprising: a block that is fixed on said plate of said support, said clip receiving seat being formed by a hollow formed in said block; two further plates fixed on said block and forming a gap and a channel together with said block, said channel and said gap being aligned with said receptacle, and said channel being engageable by said transfer pusher in order to transfer said first clip from said clip receiving seat into said receptacle.

8. The apparatus of claim 7, further comprising an elastic lamina accommodated in said channel and having an edge that protrudes into said hollow to form said clip receiving seat for receiving said first clip.

9. The apparatus of claim 8, wherein said block is provided with a tooth, said seat of the transfer pusher which receives said second clip in said pusher being centrally provided with an opening that can be engaged by said tooth of said block, said tooth being further adapted to expel said second clip from said seat of the transfer pusher when said transfer pusher is in the final position.

10. The apparatus of claim 2, comprising two magazines for said disks, with a first magazine being supported by said plate on one side of said mattress, and a second magazine being supported by said frame on the other side of said mattress.

11. The apparatus of claim 10, wherein each one of said magazines is constituted by a case formed by two parallel strips provided with mutually opposite slots mutually connected by a wall provided with an opening that is aligned with said needle, said opposite slots forming a retention seat for a column of said disks, a lowermost one of which faces said openings.

12. The apparatus of claim 10, wherein said frame comprises: two rectangular walls, which are flat and mutually parallel, so as to delimit therebetween a space for accommodating a mattress, said rectangular walls having mutually opposite holes at the points of application of said tufting straps; wall actuation means for moving one of said walls with respect to the other between a spaced position for receiving the mattress in said space and a closer position, in which said mattress is compressed down to a thickness that is smaller than the length of the tufting straps; a carriage that is slideable on wall guides that are fixed externally to one of said rectangular walls, said carriage being provided with a carriage guide for the sliding of a carriage slide at right angles to said carriage, said device and the first magazine of disks being supported on said carriage slide; movement means for moving said carriage and said carriage slide on said wall and carriage guides according to a system of X-Y axes so as to position said needle in alignment with said opposite holes in order to allow said needle to pass through a disk that lies opposite said opposite holes and guide said tufting straps through said mattress so that a clip retained in said receptacle of said needle is released on a side of the mattress that lies opposite a needle insertion side, while the other clip extracts said disk from said magazine.

13. The apparatus of claim 12, comprising: a second carriage slideable on second carriage guides that are fixed externally to the second wall, along a sliding direction, said second carriage being provided with a second carriage guide for sliding of a second carriage slide at right angles to the sliding direction of said second carriage, said second slider supporting the second magazine of disks; and second movement means for moving said second carriage and said second slide according to a system of X-Y axes so as to position said second magazine synchronously with said device, with said needle, after passing through a disk of said first magazine and the mattress, carrying a clip retained in the receptacle through a disk of said second magazine.

14. The apparatus of claim 13, wherein said movement and second movement means for moving each one of said first and second carriages comprise: pairs of pulleys; a reversible gearmotor; a shaft being provided for rotationally connecting two respective pulleys of said pairs, said shaft being actuated by a reversible gearmotor; and two belts that are arranged on sides of the respective opposite walls and are closed in a loop around respective ones of said pairs of pulleys so as to lie parallel to said wall and carriage guides.

15. The apparatus of claim 14, comprising wall rotation means, said opposite walls being supported so as to rotate about a horizontal axis, by action of said wall rotation means, between a spaced position, in which the walls lie horizontally in order to allow the insertion of a mattress in said space, and a position in which the walls lie vertically and mutually closer, in order to lock the mattress so as to allow application of said tufting straps.

16. The apparatus of claim 15, wherein said wall actuation means for moving said walls with respect to each other are constituted by jacks having each a cylinder rigidly coupled to a side of one of said opposite walls and a stem rigidly coupled to the side of the other one of said opposite walls.

17. The apparatus of claim 16, further comprising a control unit that controls movements of said movement and second movement means for actuating said carriage slides and said carriages according to a predetermined and presettable program.

18. The apparatus of claim 17, wherein said control unit controls said transfer element, a fluid-actuated cylinder, said first actuation means which comprise a linear actuator for advancement of the needle, and a rod actuated by said fluid-actuated cylinder for retaining said first clip into said receptacle.

19. The apparatus of claim 13, wherein said movement and second movement means for moving said carriages for supporting said device comprise: pairs of pulleys; a shaft for connecting two respective ones of said pulleys of said pairs; two belts, which are arranged to sides of a respective one of said opposite walls, said belts being closed in a loop around respective ones of said pairs of pulleys so as to lie parallel to said guides; and counterweights for said device and said carriages, which are fixed on said belts.

* * * * *